United States Patent [19]

Bishop

[11] Patent Number: 4,964,349

[45] Date of Patent: Oct. 23, 1990

[54] LOAD CARRYING PLATFORMS

[75] Inventor: Frank W. Bishop, Norfolk, England

[73] Assignee: American Coastal Industries, Arlington, Va.

[21] Appl. No.: 304,220

[22] Filed: Jan. 31, 1989

[51] Int. Cl.[5] ..... B65D 19/44

[52] U.S. Cl. ..... 108/55.1; 108/51.1

[58] Field of Search ..... 108/55.1, 55.3, 55.5, 108/56.1, 51.1; 206/600; 414/490

[56] References Cited

U.S. PATENT DOCUMENTS

| | | | |
|---|---|---|---|
| 1,728,920 | 9/1929 | Bentley | 108/51.1 X |
| 3,802,357 | 4/1974 | Shahani | 108/55.1 X |
| 3,880,286 | 4/1975 | Wegener | 108/56.3 X |
| 4,240,359 | 12/1980 | Howe | 108/55.1 X |
| 4,314,686 | 2/1982 | Marz | 108/55.1 X |
| 4,319,732 | 3/1982 | Godfrey | 108/53.1 X |
| 4,355,732 | 10/1982 | Nessfield | 108/55.3 X |

FOREIGN PATENT DOCUMENTS

| | | | |
|---|---|---|---|
| 1143445 | 2/1963 | Fed. Rep. of Germany | 108/55.1 |

*Primary Examiner*—Jose V. Chen

*Attorney, Agent, or Firm*—Eric P. Schellin

[57] ABSTRACT

There is disclosed a cargo holder having a planar bottom of a rectangularly shaped configuration. The bottom has two depending girders along its longest dimension. They are each spaced from a center imaginary line. The shortest ends of the bottom has a depending wall with an opening between the said girders. The bottom corners of the depending wall has a corner fact. The same shortest ends of the bottom also has foldable upstanding end walls which terminate at each of the corners at the top with corner fitments. The end walls are designed to fold inwardly downwardly in confrontation with the bottom of the cargo holder so that the cargo holder, when empty and the end walls folded, may be easily stacked to thereby conserve space. The end walls are horizontally hinged at proximate the bottom. The hinge however is essentially by-passed for any weight distribution that may be imposed on the top of the end wall when any loaded cargo holders are stacked thereon top as the end walls rest directly on an unique surface provided along the side ends of the upwardly facing portion of the depending wall. The end walls are also provided with a biasing structure to bias the end wall upwardly while at the same time to supply no bias when the end walls are folded downwardly.

2 Claims, 3 Drawing Sheets

33
32
36
34
37
17

41
40
29
27
26
25
28A
31
32

LOAD CARRYING PLATFORMS

BACKGROUND OF THE INVENTION

Considerable progress has been made to employ standardized containers for shipping goods by air, truck and/or ships. These containers have been internationally standardized to be about forty feet in length, eight feet in width and about eight feet in height. There are other standardizations, such as the weight of cargo that they must be able to adequately handle. An important standard resides in the fact that the containers are to be stackable in the hold or on a deck of a ship. To accomplish this satisfactorily it has been decided to distribute the load of a container above a first container by distributing the weight to only the end walls of the lower container. This was accomplished by supplying corner feet to all of the corners of a container and to supply weight distribution fitments to the top corners of the containers at their respective end walls.

In each instance the feet and the upper corner are the protrusions that are most extending so that they not only receive the weight from the container thereabove but also distribute the weight directly therebelow.

The upper corners are also adapted and constructed whereby the container may be picked up by their upper corner fitments and transported by a crane or gantry to be re-positioned in the ship or onto another vessel or onto shore as desired.

These containers are also adapted to be handled and loaded onto specialized trucks and to be carried to destinations thereon as desired. U.S. Pat. No. 4,132,325 discloses such a truck for loading and unloading and carrying a container of the type contemplated although the container of the present invention is an ingenious improvement over such such container.

As such, it should be noted that the container has an elongated tunnel below the cargo carrying bottom whereby part of the mechanism of the container handling equipment may fit into the tunnel and under the container at the conclusion of loading the specialized truck.

Frequently, such containers with which the present invention pertains is of a type which does not require side walls nor does it need a roof. In such instances, it would be wise to provide for fold down end walls to thereby compact the cargo holder. In such a compacted position a plurality of cargo holders may be stacked one on top of the other to thereby conserve space.

To make a cargo holder with foldable end walls would ordinarily put unacceptable strains on any hinge employed especially when undue weight from stacked containers is put on the end walls of containers in lower positions.

It is therefore an object of the invention to disclose and claim a cargo container having foldable side walls wherein the burden of the weight imposed on the respective end walls is not placed directly on a hinge but is transferred to a stoop means positioned on the portion of a separate wall directly below.

It is also an object to rigidly control the degree of rotatability of the said upper portion of the end wall to avoid over rotation even when cargo may be thrust against the inside portion of the end wall.

It is also an object to lock the upper end wall portion into position until it is desired to release it to assume a folded down position.

SUMMARY OF THE INVENTION

There is disclosed a cargo holder having a planar bottom of a rectangularly shaped configuration. The bottom has two depending girders along its longest dimension. They are each equi-distantly spaced from a center immaginary line. The shorter ends of the bottom each has a depending wall with an opening between the said girders. The bottom corners of the depending wall has a corner foot at both sides. The same shorter ends of the bottom also has foldable upstanding end walls which terminate at each of the corners at the top with corner fitments. The end walls are designed to fold inwardly in confrontation with the bottom of the cargo holder so that the cargo holder when empty and the end walls are folded it may be easily stacked to thereby conserve space. The end walls are horizontally hinged at proximate the bottom. The hinge however is essentially by-passed for any weight distribution that may be imposed on the top of each of the end walls when any loaded cargo holders are stacked therein, as the end walls rest directly on the corner fitment. The end walls are also provided with a biasing means to bias the end wall upwardly while at the same time to supply no bias when the end wall is folded downwardly.

DETAILED DESCRIPTION OF THE INVENTION

Figure 1:
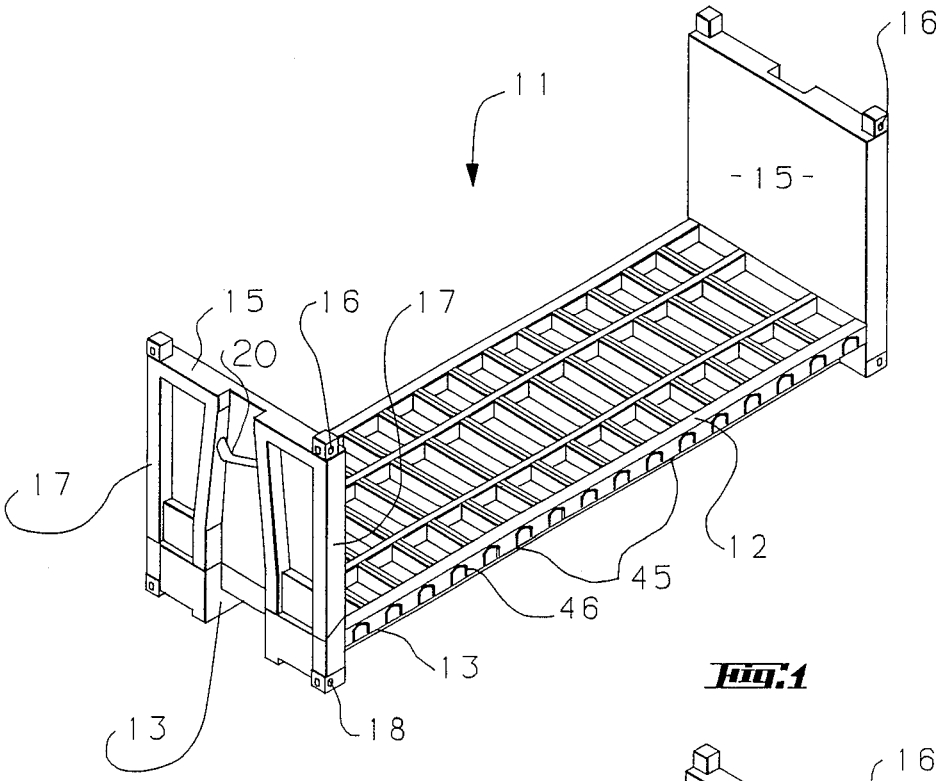
FIG. 1 is a perspective view of the cargo holder of the present invention.
Figure 2:
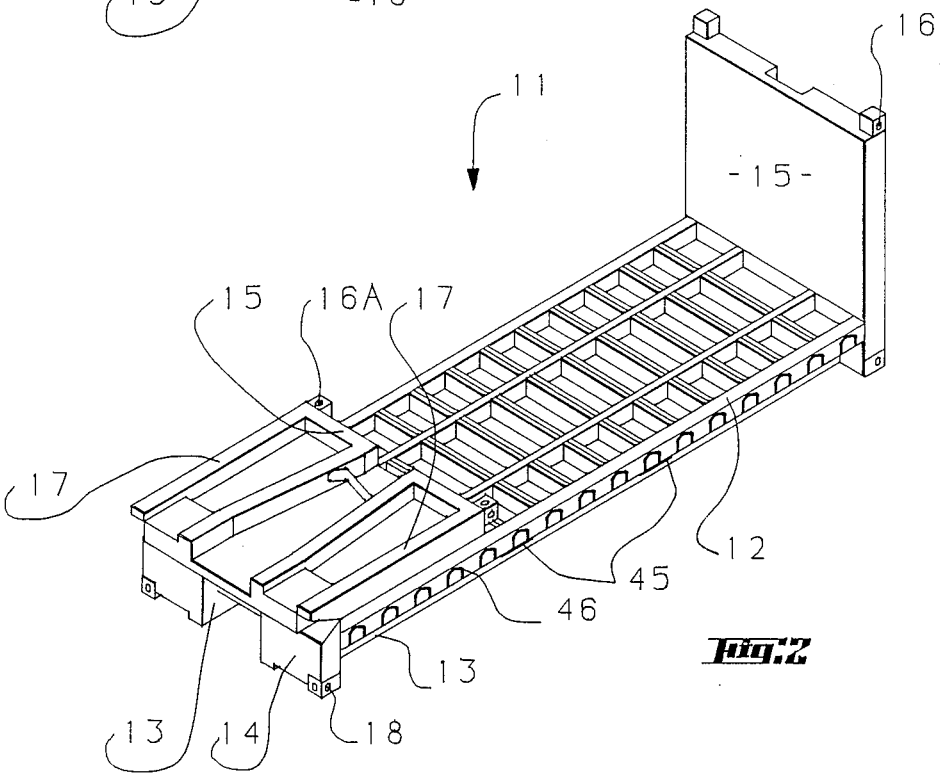
FIG. 2 is an end view of the cargo holder of the present invention.

The cargo holder of the present invention is shown, generally, by reference number 11. The cargo holder has a planar bottom 12 of a generally rectangularly shaped configuration. Depending from the bottom are horizontally displaced girders 13 which are positioned along the longest dimension of the cargo holder 11 and are each equi-distant from an axial immaginary center line.

The ends of the cargo holder has a depending fixed end lower wall 14 ending at the bottom thereof with corner support feet 18. The end lower walls 14 do not extend over the space between the girders 13 as it is desirable to leave the space therebetween open for useful placement of the cargo holder onto a specialized truck (not shown). The bottom also has upwardly extending therefrom a downwardly foldable end wall 15. Each of the tops thereof is mounted with a corner support fitment 16.

The upwardly extending end walls 15 are of considerable strength having side edge box girders 17 t distribute any weight imposed on the corner support fitments 16 downwardly in the direction of the feet 18.

The end walls 15 also have bail bar 20 to which a crane hook or other hoisting means may be secured for raising or lowering the cargo holder while being loaded with cargo. It is positioned between inverted V-shaped box girders 21. The end walls 15 are further framed by top box girder 22. The area between the girders is covered at the internally facing ends with a web steel surface 23.

Figure 3:
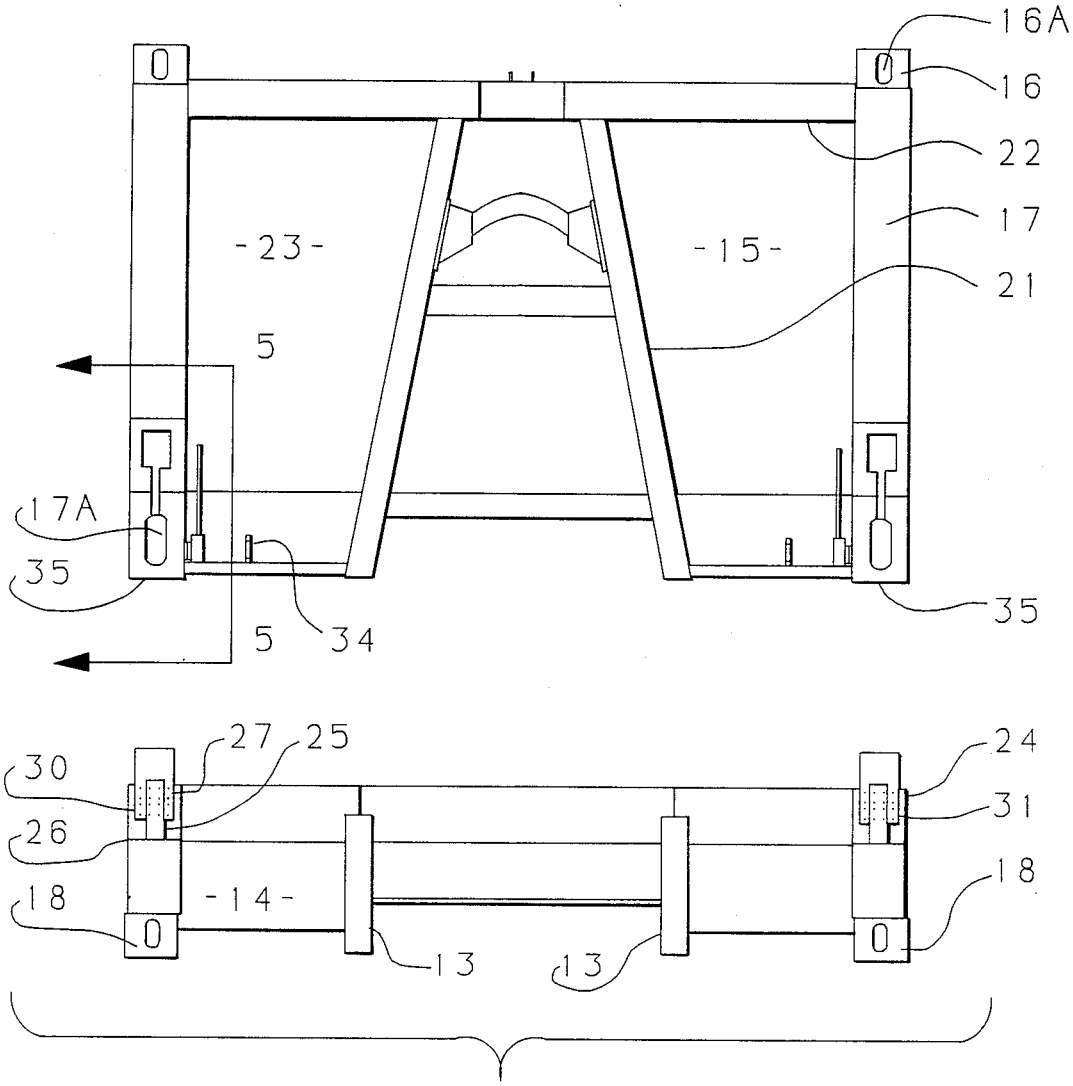
FIG. 3 is an exploded end view of the cargo holder of the present invention.

The end lower wall 14 carries a hinge 24. For a better understanding of the hinge 24 attention is directed to FIG. 3 taken together with FIG. 5. The hinges at each side of the end lower wall 14 in FIG. 3 is an end view while in FIG. 5 the view is a side view thereof.

Affixed to the end lower wall 14 is an upstanding first leaf member 25. As a weight distribution means, positioned to the back of the upstanding member is an abutment stool 26 which consists of outwardly and upwardly facing flat acute angled surface 27. The upper extending end walls 15 are also fitted with a downwardly and inwardly facing flat surface that is at an acute angle with respect to said upper extending end wall. Pivotally connected to the leaf member 25 is a bifurcated second leaf member 28 which is pivotted to the first leaf member 25 by pintle 29. The second leaf member is fixedly mounted into the bottom of hollow girders 17 through opening 35. The bifurcations 30 embrace first leaf member 25. A bore 31 through the bifurcations 30 and the part of the leaf member 25 embraced by the bifurcations provide a locking aperture for a retractable pin 32. The pin 32 is driven into place by lever 33 which moves to and fro under the aegis of cam action from stop 34 to the bore engaging position.

It will be noted from the exploded Figure that the second leaf member 28 extends into the bottom of girder 17 through opening 35 in alignment with pin aperture 36 of the girder 17. The pintle 29 extends through bore 37 in the girder 17, the bifurcations 30 and leaf member 25 as the bore 37 is in alignment. The second leaf member 28 has an ear 28A which protudes slightly through opening 17A of the girder 17 when the end wall is in an upright position.

Figures 4, 5:
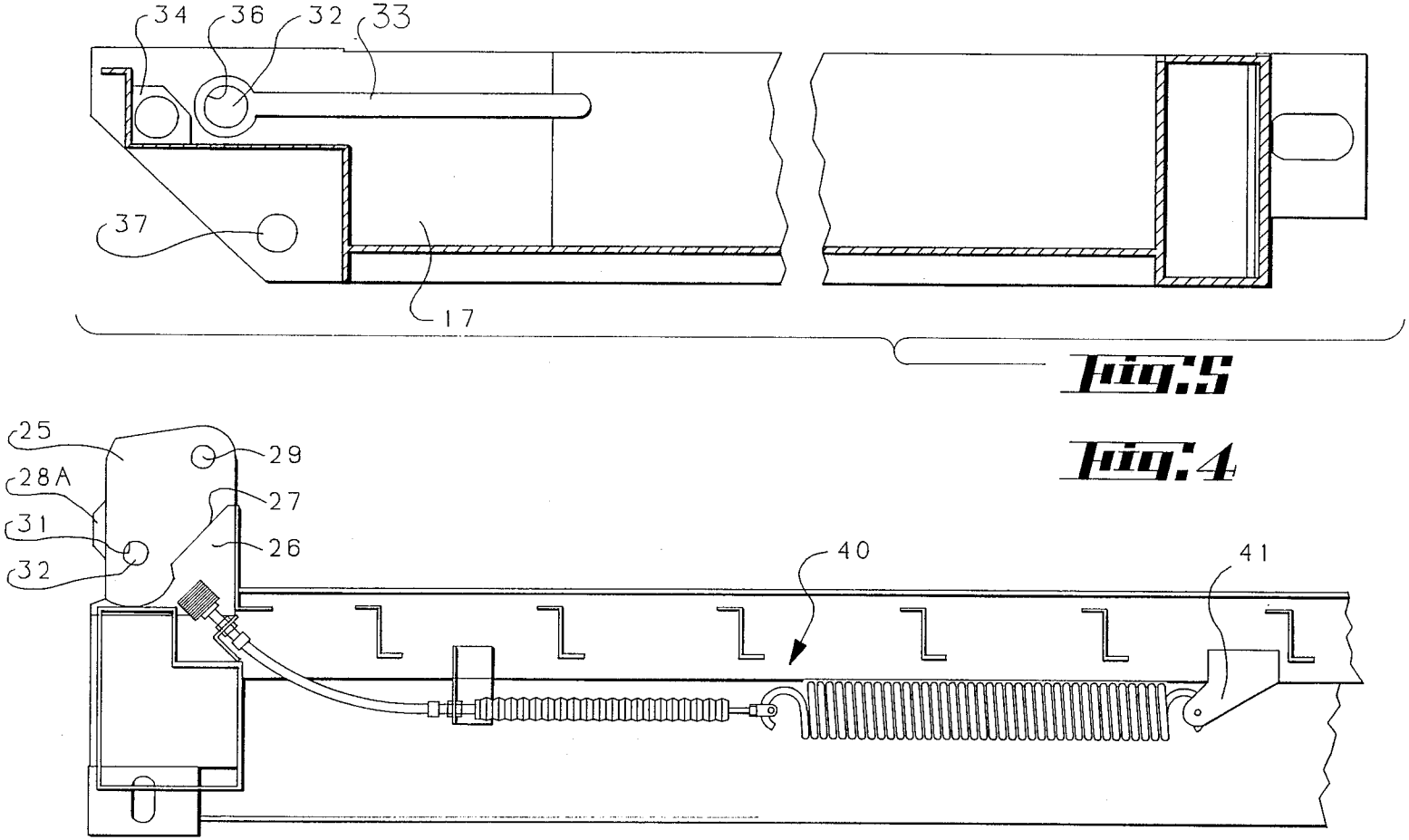
FIG. 4 is a side view of the spring means to bias the upper end wall into a vertical position.
FIG. 5 is a fragmentary cross-section taken along lines 5—5 of FIG. 3.

In regard to FIG. 4 the lower bottom of the girder 17 (not shown by this Figure) has at one side thereof an elongated helical spring means 40 which has its other end attached to a holder 41. Each of the end walls has such a spring means whereby the end wall is urged into an upward vertical position except when the wall is completely folded down, then the spring means does not exert any biasing on the end wall until it raised slightly from the horizontal at which point the spring biases the end wall to the vertical.

It will be appreciated that a cargo load may be placed within the boundaries as defined by the bottom and the end walls. The cargo holder may be lifted by fork lift truck having its tines positioned in suitable openings 45 transversely of girders 13. More importantly, the entire cargo holder may be hoisted by a suitably positioned travelling hoist in a gantry or the like for attachment to the upper corner filments 16 by means of orifices 16A, therein.

The cargo holders of the present invention may be stacked one on top of the other by positioning the feet 18 of a first loaded cargo holder onto the corner fitments 16 below of a second cargo holder. As the feet and the corner fitments are the furthermost protrusions it will be seen that all of the weight of a cargo holder above a first cargo holder is transmitted to the end walls of the cargo below and not onto the cargo in a cargo holder below. Additional stacking may be accomplished.

The cargo holders of the present invention may be suitably fitted to hold tied down cargo and to this end conventional D-shaped tie down loops 46 are provided. The upper surface of the bottom 12 of the cargo holder may be covered with wooden planks or other material as desired.

The cargo holder may be supplied with a plurality of gull wing doors for easy access to the contents of the cargo holder. The cargo holder may be provided with an outer framework with an expansible blader positioned therebetween for containing a fluid.

The uniqueness of the capability of the foldability of the end walls will be appreciated when one considers that an empty cargo holder consumes an inordinate amount of space. On the other hand space can be conserved when the end walls are folded down. In such a position the folded cargo holders can be stacked one upon the other for storing until the cargo holder is to be employed.

What is claimed is:

1. A load carrying platform comprising a rectangular planar bottom, said planar bottom having sides and ends, said sides being longer than said ends, two elongated spaced support members depending from said planar bottom parallel to the sides and indented equidistantly from the sides, a lower wall depending perpendicularly from each of the ends of the planar bottom, each of said lower walls having a central cut out portion whereby each of said lower walls together with said elongated support members and said bottom define an essentially unobstructed elongated bridge axially along said bottom, a hinged upper wall extendable perpendicularly from at least one end of said planar bottom adjacent a lower wall, weight distribution means integral with said upper and lower walls to distribute any imposed weight onto the upper wall downwardly onto said lower wall while essentially bypassing the hinge of said upper wall, said weight distribution means including a first abutment means extending upwardly from said lower wall at the end having said hinged upper wall, said first abutment means terminating in an outwardly and upwardly facing first flat surface that is at an acute angle with respect to said lower wall and said weight distribution means including a second abutment means extending downwardly from said upper wall, said second abutment means terminating in an inwardly and downwardly facing second flat surface that is at an acute angle with respect to said upper wall whereby said upper wall rests on said lower wall through said first and second flat surfaces when said upper wall is perpendicular to said planar bottom.

2. The load carrying platform according to claim 1 wherein the first and second flat surfaces each having mating abutment means whereby said upper wall is prevented from exceeding a perpendicular position with respect to said planar bottom.

* * * * *